US008075394B2

(12) United States Patent
Okada et al.

(10) Patent No.: US 8,075,394 B2
(45) Date of Patent: Dec. 13, 2011

(54) GAMING MACHINE AND GAME SYSTEM

(75) Inventors: Kazuo Okada, Tokyo (JP); Masatsugu Kobayashi, Tokyo (JP); Toshiya Ogawa, Tokyo (JP); Mayumi Takeda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1219 days.

(21) Appl. No.: 11/228,204

(22) Filed: Sep. 19, 2005

(65) Prior Publication Data

US 2006/0068888 A1 Mar. 30, 2006

(30) Foreign Application Priority Data

Sep. 30, 2004 (JP) ..... 2004-287100
Oct. 12, 2004 (JP) ..... 2004-297991

(51) Int. Cl.
*A63F 9/24* (2006.01)

(52) U.S. Cl. ..... 463/25; 463/20; 463/29

(58) Field of Classification Search ..... 463/25, 463/27, 20, 29
See application file for complete search history.

(56) References Cited

U.S. PATENT DOCUMENTS 5,655,961 A * 8/1997 Acres et al. ..... 463/27
5,770,533 A 6/1998 Franchi
5,876,284 A * 3/1999 Acres et al. ..... 463/25
6,003,013 A * 12/1999 Boushy et al. ..... 705/10
6,055,512 A * 4/2000 Dean et al. ..... 705/17
6,077,162 A 6/2000 Weiss
6,506,116 B1 1/2003 Sunaga et al.
6,712,698 B2 * 3/2004 Paulsen et al. ..... 463/30
6,769,986 B2 * 8/2004 Vancura ..... 463/30
6,843,724 B2 * 1/2005 Walker et al. ..... 463/25
7,040,987 B2 * 5/2006 Walker et al. ..... 463/42
7,175,528 B1 * 2/2007 Cumbers ..... 463/29
7,198,571 B2 * 4/2007 LeMay et al. ..... 463/25
7,419,427 B2 * 9/2008 Boushy ..... 463/25
7,427,233 B2 * 9/2008 Walker et al. ..... 463/16
7,451,401 B2 * 11/2008 Tanskanen et al. ..... 715/744
7,559,838 B2 * 7/2009 Walker et al. ..... 463/21
7,689,302 B2 * 3/2010 Schlottmann et al. ..... 700/91
7,722,453 B2 * 5/2010 Lark et al. ..... 463/16
2002/0013173 A1 * 1/2002 Walker et al. ..... 463/40
2002/0107715 A1 * 8/2002 Pace et al. ..... 705/8
2002/0142825 A1 10/2002 Lark et al.
2002/0151366 A1 10/2002 Walker et al.
2003/0050806 A1 * 3/2003 Friesen et al. ..... 705/5
2003/0054868 A1 * 3/2003 Paulsen et al. ..... 463/1
2003/0054878 A1 * 3/2003 Benoy et al. ..... 463/29
2003/0064771 A1 * 4/2003 Morrow et al. ..... 463/16
2003/0078101 A1 * 4/2003 Schneider et al. ..... 463/42
2003/0176218 A1 * 9/2003 LeMay et al. ..... 463/25
2003/0187736 A1 * 10/2003 Teague et al. ..... 705/14
2003/0195031 A1 * 10/2003 O'Donovan et al. ..... 463/16

(Continued)

FOREIGN PATENT DOCUMENTS

AU 2004201790 A1 5/2004

(Continued)

*Primary Examiner* — Omkar Deodhar
(74) *Attorney, Agent, or Firm* — Oblon, Spivak, McClelland, Maier & Neustadt, L.L.P.

(57) ABSTRACT

A gaming machine has a receiving unit which externally receives game rate data and setting unit which sets a game rate based on the game rate data received by the receiving unit. In the gaming machine, processing relating to a game is performed based on the game rate set by the setting unit.

7 Claims, 14 Drawing Sheets

TB

| GAME RATE CALCULATION DATA | | | GAME RATES | | |
|---|---|---|---|---|---|
| | | | GROUPS | | |
| HIGH | MIDDLE | LOW | A | B | C |
| ~75% | D.C | D.C | 1 DOLLAR | 1 DOLLAR | 1 DOLLAR |
| 75~50% | D.C | 33%~ | 1 DOLLAR | 1 DOLLAR | 50 CENTS |
| 75~50% | D.C | ~33% | 1 DOLLAR | 1 DOLLAR | 25 CENTS |
| 50~25% | ~50% | D.C | 1 DOLLAR | 50 CENTS | 50 CENTS |
| | | | | | |

U.S. PATENT DOCUMENTS

| | | | | |
|---|---|---|---|---|
| 2004/0107169 | A1* | 6/2004 | Lowe | 705/59 |
| 2004/0128160 | A1* | 7/2004 | Fujimoto | 705/1 |
| 2004/0138917 | A1* | 7/2004 | Fujimoto | 705/1 |
| 2004/0139017 | A1 | 7/2004 | Fujimoto | |
| 2004/0158536 | A1* | 8/2004 | Kowal et al. | 705/400 |
| 2004/0166940 | A1* | 8/2004 | Rothschild | 463/42 |
| 2004/0229698 | A1* | 11/2004 | Lind et al. | 463/42 |
| 2004/0242319 | A1* | 12/2004 | Walker et al. | 463/25 |
| 2004/0242324 | A9* | 12/2004 | Walker et al. | 463/40 |
| 2004/0254010 | A1* | 12/2004 | Fine | 463/25 |
| 2005/0075165 | A1* | 4/2005 | George et al. | 463/29 |
| 2005/0124411 | A1* | 6/2005 | Schneider et al. | 463/29 |
| 2007/0135213 | A1* | 6/2007 | Walker et al. | 463/29 |

FOREIGN PATENT DOCUMENTS

| | | | |
|---|---|---|---|
| CN | 1289881 | A | 4/2001 |
| CN | 2003101214156 | | 8/2004 |
| EP | 1 498 857 | A2 | 1/2005 |
| JP | 08-057143 | | 3/1996 |
| JP | 2003-162588 | | 6/2003 |
| RU | 2138923 | C1 | 9/1999 |
| WO | WO 94/14284 | | 6/1994 |
| WO | WO 2005/002691 | A2 | 1/2005 |

* cited by examiner

FIG. 11

TB

| GAME RATE CALCULATION DATA | | | GAME RATES | | |
|---|---|---|---|---|---|
| HIGH | MIDDLE | LOW | GROUPS | | |
| | | | A | B | C |
| ~75% | D.C | D.C | 1 DOLLAR | 1 DOLLAR | 1 DOLLAR |
| 75~50% | D.C | 33%~ | 1 DOLLAR | 1 DOLLAR | 50 CENTS |
| 75~50% | D.C | ~33% | 1 DOLLAR | 1 DOLLAR | 25 CENTS |
| 50~25% | ~50% | D.C | 1 DOLLAR | 50 CENTS | 50 CENTS |
| | | | | | |

GAMING MACHINE AND GAME SYSTEM

CROSS REFERENCE TO RELATED APPLICATION

This application is based upon and claims the benefit of priority from the prior Japanese Patent Applications No. 2004-287100, filed on Sep. 30, 2004 and No. 2004-297991, filed on Oct. 12, 2004, the entire contents of which are incorporated herein by reference.

BACKGROUND OF THE INVENTION

1. Field of the Invention

The present invention relates to a gaming machine such as a slot machine, a pachi-slot machine and a pachinko machine and a game system including gaming machines connecting to an external apparatus via a network.

2. Description of Related Art

In a gaming machine such as a slot machine, a pachi-slot machine and a pachinko machine, a game charge for one game or for one line, i.e., a game rate is predetermined, and a payout is provided for a win based on the game rate. For example, when a winning combination is completed in a slot machine the game rate of which is one dollar, a one-dollar coin or coins is/are paid out or the corresponding value is accumulated in a credit valued which is stored, where the number of coins is equal to the number resulting from the multiplication of bet value by a number in accordance with the winning combination. When a winning combination is completed in a slot machine for 25-cent coins, a 25-cent coin or coins is/are paid out or the corresponding value is accumulated in a credit valued which is stored, where the number of coins is equal to the number resulting from the multiplication of bet value by a number in accordance with the winning combination.

A gaming machine is known in which a game rate is changeable by a player (See U.S. Pat. No. 6,506,116). For example, a gaming machine is known a game rate setting switch of which may be operated so that a player can arbitrarily select one of an operation mode with a game rate of 1 dollar, an operation mode with a game rate of 50 cents and an operation mode with a game rate of 25 cents.

SUMMARY OF THE INVENTION

In a gaming place such as a casino within a hotel, players may include not only regular visitors but also many beginners playing only during a day or days they are staying and many foreigners. The beginners and foreigners trying to play games may feel the operations for the function of setting a game rate in each of the gaming machines as described above complicated and often play games with a preset game rate without using the function. In this case, the function of setting a game rate provided in gaming machines may come to nothing, and, as a result, the sales in the gaming place may be lower than that estimated by a manager.

The proper game rate may depend on the class of customers staying at a hotel. For example, one dollar may be proper for some classes of customers while 50 or 25 cents may be proper for some other classes of customers. Therefore, the game rate is preferably preset in accordance with the class of customers each day. The game rate is preferably set in accordance with the class of a party of tourists only during a time period when the party of tourists plays games. However, when a staff member of a gaming place sets a game rate, he/she needs to manipulate a game rate setting switch for each gaming machine, which takes a long time if many gaming machines are placed.

It is an object of the invention to provide a gaming machine and game system in which a game rate can be set easily without requiring a player or a staff member of a gaming place to perform a complicated operation.

According to an aspect of the invention, there is provided a gaming machine including: a receiving unit which externally receives game rate data; and a setting unit which sets a game rate based on the game rate data received by the receiving unit. In the gaming machine, processing relating to a game is performed based on the game rate set by the setting unit.

According to the gaming machine above, a game rate can be set easily without requiring a player or a staff member of a gaming place to perform a complicated operation.

BRIEF DESCRIPTION OF THE DRAWINGS

Other and further objects, features and advantages of the invention will appear more fully from the following description taken in connection with the accompanying drawings in which:

FIG. 11 is an explanatory diagram showing a game rate calculation data/game rate conversion table;

DESCRIPTION OF THE PREFERRED EMBODIMENTS

Preferred embodiments of the invention will be described below with reference to drawings.

First of all, a game system according to a first embodiment of the invention will be described with reference to FIG. 1. In this embodiment, a slot machine placed in a gaming place within a hotel is applied as a gaming machine.

In a game system 1 of this embodiment, slot machines 2 are connected to a hotel server 3 via a network N1. As described in detail later, each of the slot machines 2 sets a game rate based on game rate data received from the hotel server 3 and then performs processing relating to a game.

Figure 2:
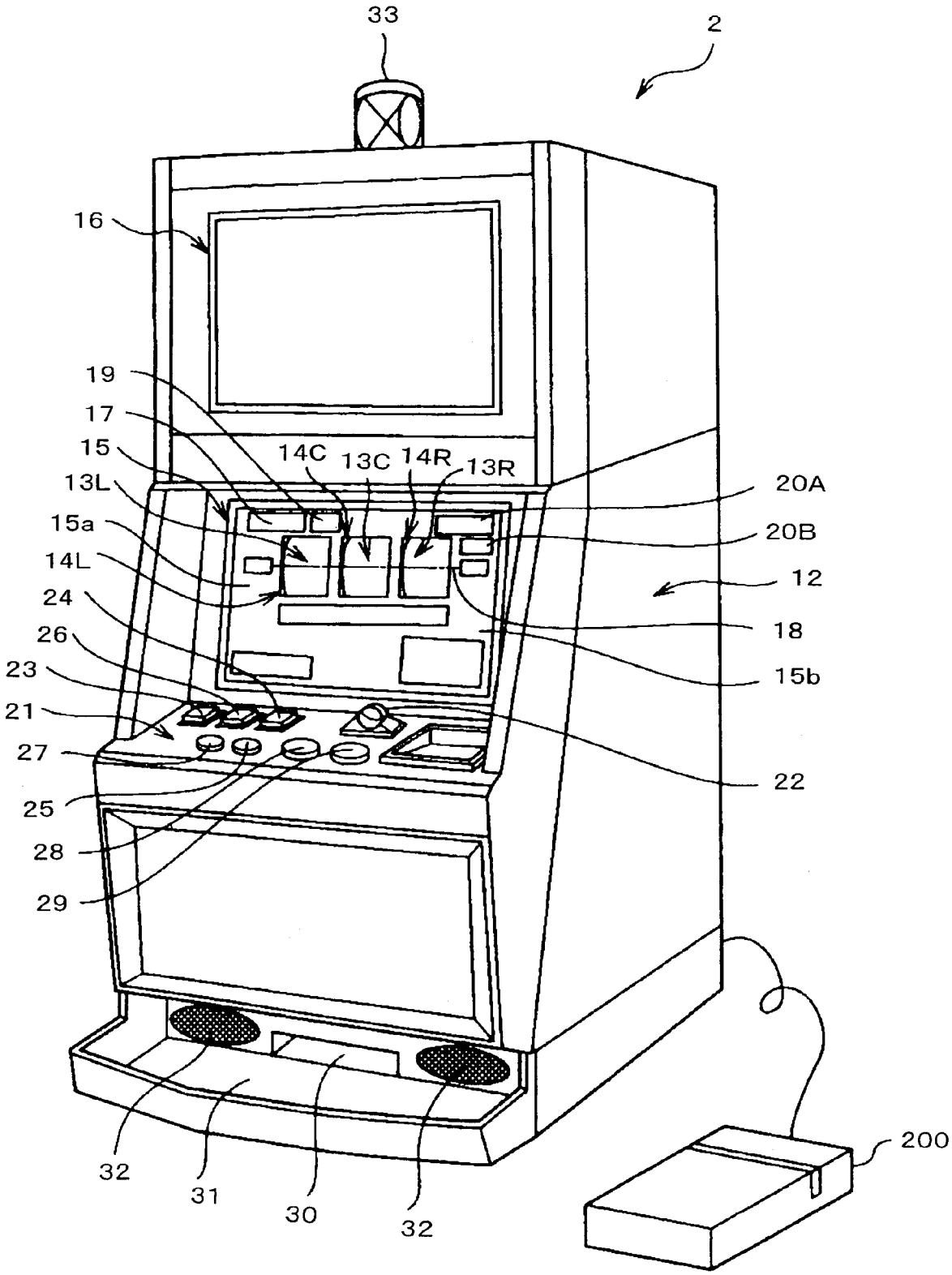
FIG. 2 is a perspective view showing a slot machine serving as a gaming machine according to the first embodiment.

Next, the slot machine 2 will be described in detail with reference to FIG. 2. As shown in FIG. 2, the slot machine 2 includes a cabinet 12 forming the appearance and further includes, on the front face of the cabinet 12, displays 15 and 16, a control panel 21 and a coin tray 31.

The sub display 16 placed on the uppermost part of the front face of the cabinet 12 displays information that a player does not always watch during a game, such as a payout table, an explanation on how to play a game with the slot machine and information on a specific game such as a bonus game.

The main display 15 placed below the sub display 16 on the front face of the cabinet 12 and substantially at the center in the direction of height displays an effect image relating to a game and a notice information from the gaming place, for example. A horizontal array of three reels 13L, 13C and 13R is rotatably supported behind the main display 15 within the cabinet 12, and the main display 15 has transmissive windows 14L, 14C and 14R for the reels 13L, 13C and 13R, respectively. Thus, a player can visibly recognize the symbols rendered on the surfaces of the reels 13L, 13C and 13R. One activated line 18 is rendered across the center of the three transmissive windows 14L, 14C and 14R.

In this embodiment, one kind of coin such as a one-dollar coin is inserted into the slot machine 2 and is paid out by the slot machine 2, and each of the coins of the kind has a value equal to the currently set game rate. The coin deemed as having the value equal to the set game rate is called "deemed coin", and the number of deemed coins bet on one game is called "amount bet".

The upper half 15*a* of the main display 15 includes the transmissive windows 14L, 14C and 14R and further includes a payout table indicator 17, amount-bet indicator 19 and credit-amount indicator 20*a* thereabove. A game rate indicator 20B is provided below the credit-amount indicator 20A. The payout indicator 17 displays a payout to be given when a winning combination is completed in a slot game, which is a basic game of the slot machine 2. The amount-bet indicator 19 displays the number of deemed coins bet on one game, that is, displays an amount bet. The credit-amount indicator 20A displays the number of currently deposited real coins or the number of deemed coins resulting from the conversion of the number of the currently deposited coins based on the game rate. Note that the number of real coins and the number of deemed coins may be displayed by separate credit-amount indicators. The game rate indicator 20B displays the currently set game rate. The substantially lower half 15*b* of the main display 15 displays a notice information, for example.

The control panel 21 positioned below the main display 15 includes a coin insertion slot 22 through which a coin is inserted by a player and switches 23, 24, 25, 26, 27, 28 and 29.

The error switch 23 is a switch to be pressed when the slot machine 2 has a problem. In response to the press, an error lamp 33 on the top face of the cabinet 12 lights up to call a staff member of the gaming place. The help switch 24 is a switch to be pressed for help on how to play and/or details of a bonus game. In response to the press, an explanation thereon can be displayed on the sub display 16. The spin switch 25 is a switch to be pressed to start the rotations of the reels 13L, 13C and 13R. The cash-out switch 26 is a switch to be pressed to pay out coins deposited in the slot machine 2 from a payout opening 30 to the coin tray 31. The BET switch 27 is a switch to be pressed to bet a deemed coin deposited in the slot machine 2, and one deemed coin is bet every time the BET switch 27 is pressed once. The maximum BET spin switch 28 is a switch to be pressed to bet a maximum number of (four, for example) deemed coins bettable on one game. The repeat BET spin switch 29 is a switch to be pressed to bet, on a game, the number of deemed coins equivalent to the amount bet on the last game. When each of the maximum BET spin switch 28 and repeat BET spin switch 29 is pressed, a coin is bet as described above, and the rotations of the reels 13L, 13C and 13R are started.

The payout opening 30 and the coin tray 31 are provided in the lower part of the cabinet 12. Real coins equivalent to the amount of the deemed coins are paid out from the payout opening 30 upon completion of a winning combination. The coin tray 31 receives the coins paid out from the payout opening 30. Speaker grilles 32 are provided on both sides of the payout opening 30 for outputting, to the outside, a sound output from a speaker 53 (see FIG. 5) within the cabinet 12.

Furthermore, a card reader 200 is externally provided to the cabinet 12. The card reader 200 reads the room number of a player when a room key such as a magnetic card that the player carries is inserted therethrough. Here, the room number functions as identification information of the player.

Next, the main display 15 and sub display 16 will be described in detail with reference to FIGS. 3 and 4.

Figure 3:
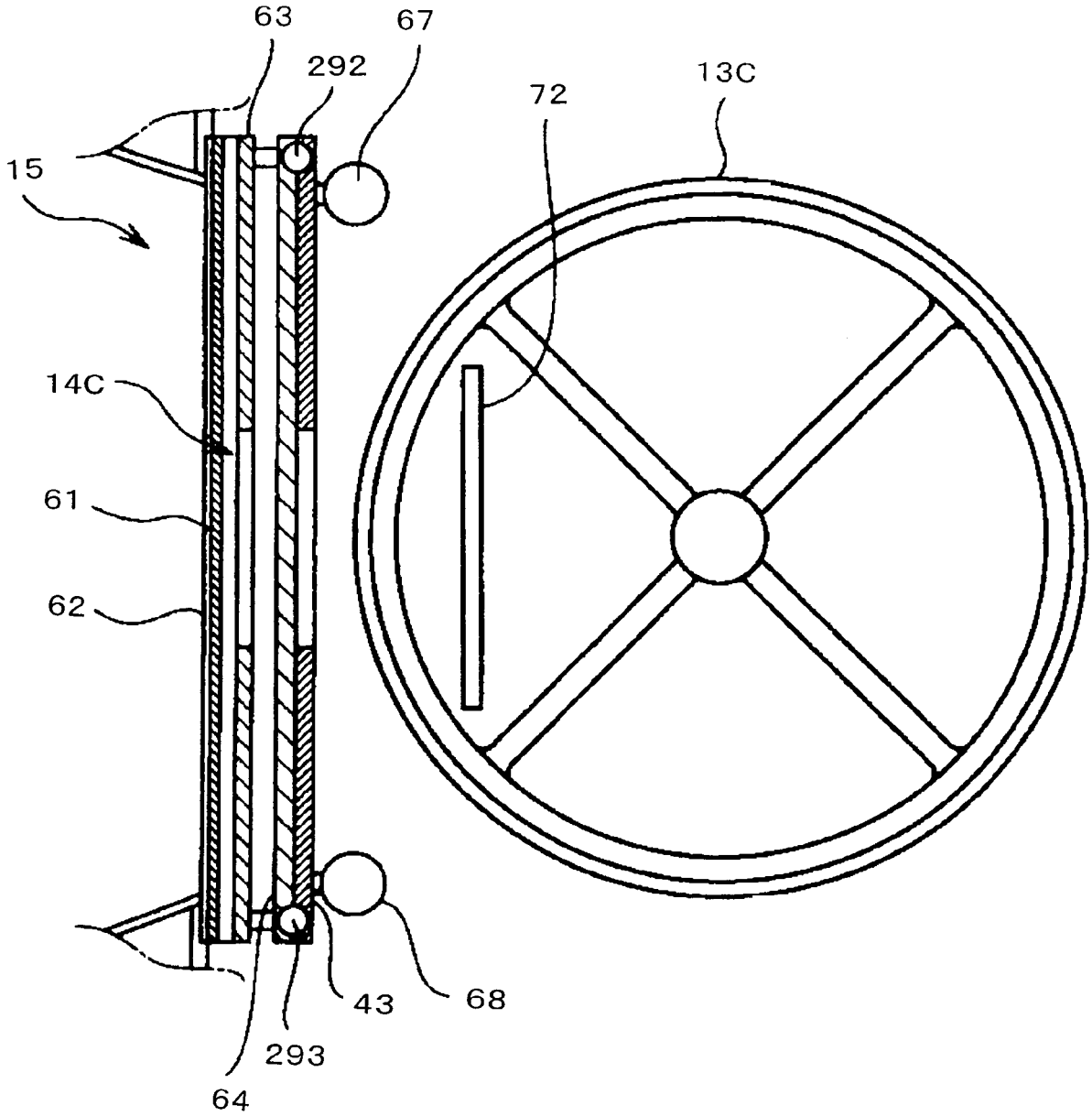
FIG. 3 is a section view showing a main display of the slot machine and reels within a cabinet thereof.

The main display 15 includes, as shown in FIG. 3, a transparent acrylic plate 63 functioning as a protector, a symbol sheet 63, a transparent liquid crystal display device 64 and a light guide plate 43, which are stacked one over another. The transparent acrylic plate 62 has a touch panel 61.

The symbol sheet 63 is formed by printing various symbols on a transparent film. The symbols rendered on the symbol sheet 63 are always visible to a player regardless of the state of a game. The transmissive window 14C for exposing the symbol on the surface of the reel 13C is provided in the symbol sheet 63 and the light guide plate 43.

The liquid crystal display device 64 has a one-pixel electrode, for example, on the surface and displays an effect image and notice information. The upper and lower ends of the liquid crystal display device 64 and light guide plate 43 have cold cathode tubes 292 and 293 functioning as backlights of the liquid crystal display device 64. By turning on the cold cathode tubes 292 and 293, a player can visually and clearly recognize the image displayed on the liquid crystal display device 64.

The upper and lower ends of the back of the light guide plate 43 have symbol illuminating lamps 67 and 68. The symbol illuminating lamps 67 and 68 illuminate the symbols rendered on the surfaces of the reels 13L, 13C and 13R such that a player can visually and clearly recognize the symbols and are controlled to light up during power supply. A lamp housing 72 is provided in a part close to the main display 15 inside of the reels 13L, 13C and 13R. The lamp housing 72 includes a reel back lamp (not shown) that lights up for easy visual recognition of symbols.

Figure 4:
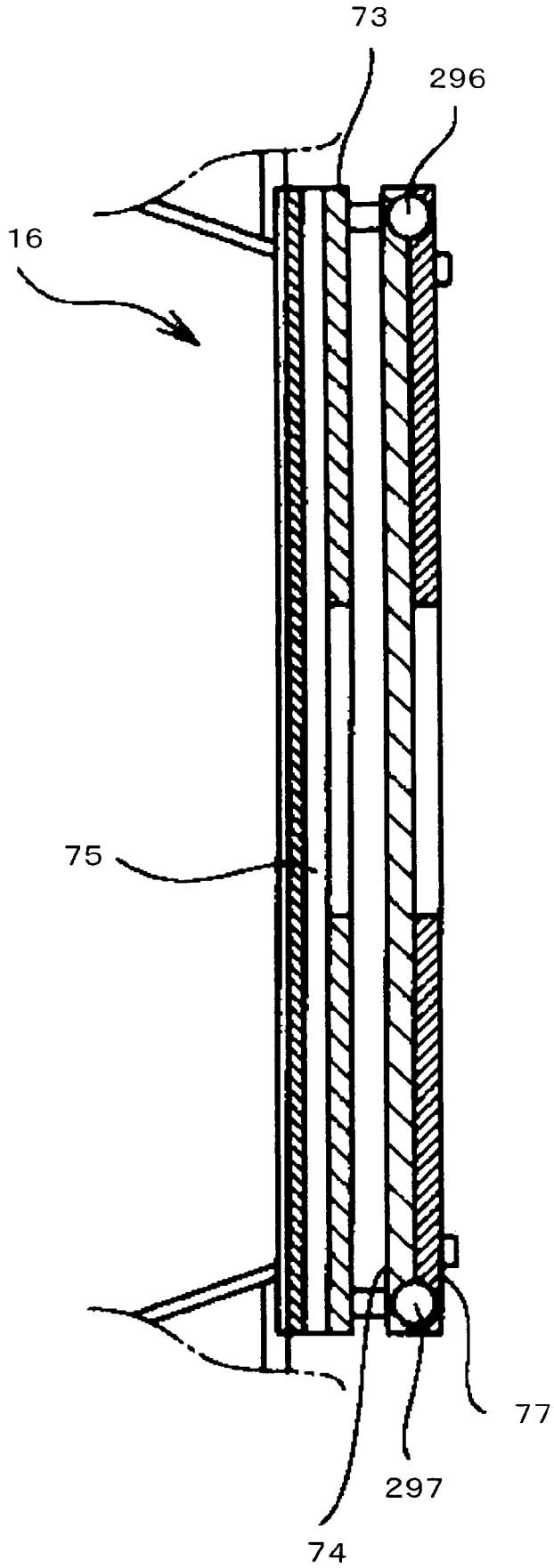
FIG. 4 is a section view showing a sub display of the slot machine.

The sub display 16 includes, as shown in FIG. 4, a transparent acrylic plate 75 functioning as a protector, a symbol sheet 73, a liquid crystal display device 74 and a light guide plate 77, which are stacked one over another as the main display 15. The upper and lower ends of the liquid crystal display device 74 and light guide plate 77 have cold cathode tubes 296 and 297 functioning as backlights of the liquid crystal display device 74. No symbol illuminating lamp is provided unlike the main display 15 since no reels are placed inside of the sub display 16.

Figure 5:
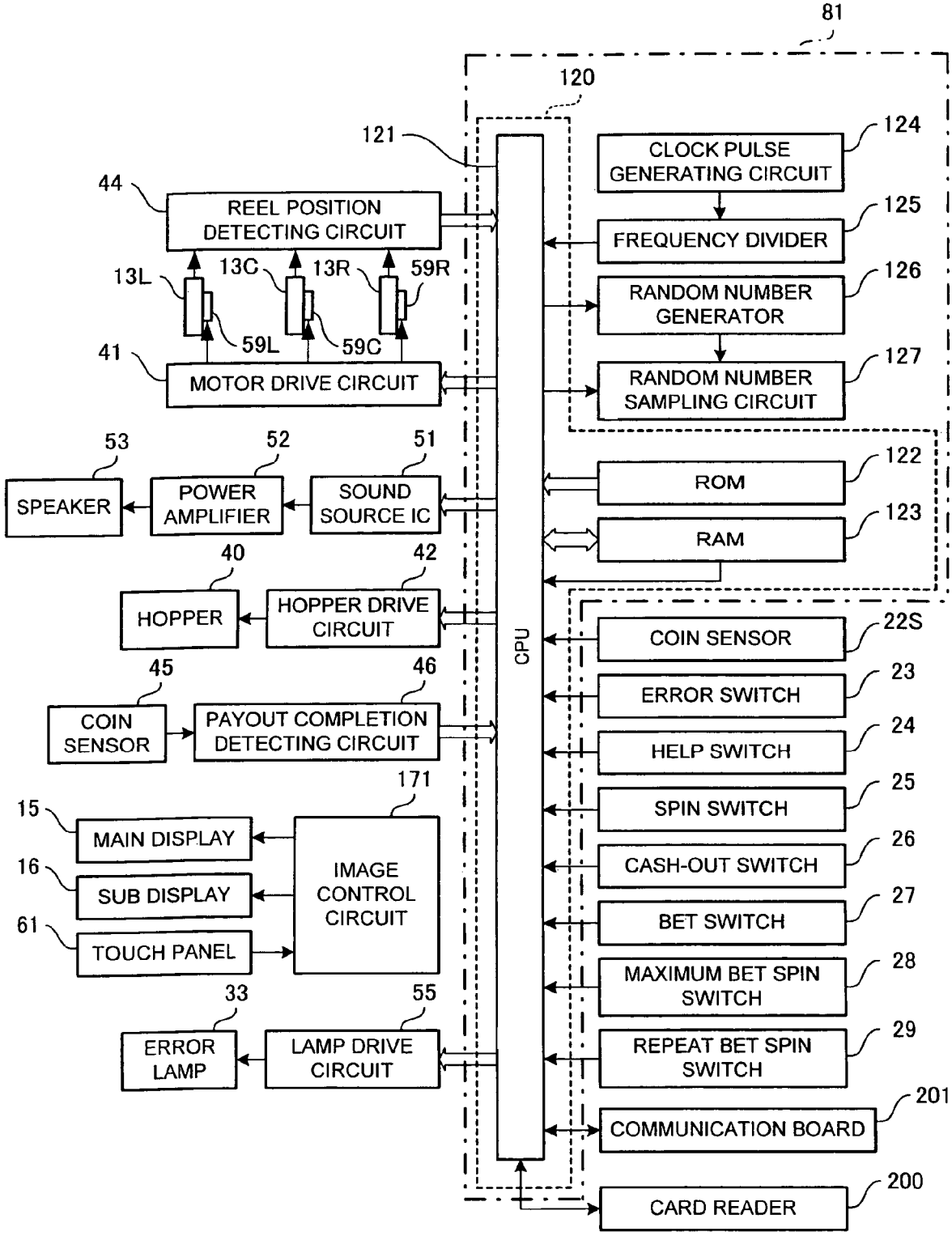
FIG. 5 is a block diagram showing a controller of the slot machine according to the first embodiment.

Next, the controller of the slot machine 2 will be described with reference to FIG. 5. The controller includes a main control circuit 81 which controls the slot machine 2 as a whole.

The main control circuit 81 includes, on a circuit substrate, a microcomputer 120 and elements 124, 125, 126 and 127 for random number sampling. The microcomputer 120 includes a CPU 121, which controls in accordance with a predefined program, and a ROM 122 and a RAM 123, both of which function as storage units.

The ROM 122 stores a program for controlling a game in the slot machine 2, a symbol arrangement table, a winning form table, a lottery table, a stop control table, a game rate setting program (see FIG. 7) and the like. The symbol arrangement table has correspondences between rotating positions of the reels 13L, 13C and 13R and symbols. More specifically, the symbol arrangement table has correspondences between code numbers and symbol codes. Each of the code numbers is given for a predetermined rotational pitch of each of the reels 13L, 13C and 13R with reference to the position where a reset pulse is generated, which will be described later. Each of the symbol codes refers to a symbol provided for each code number. The winning form table has correspondences among combinations of symbols for completion of winning combinations, payouts, that is, numbers of coins, and win determination codes. As the payouts, the winning form table may have the numbers of coins for different game rates or may have the number of coins for a predetermined game rate. For a game rate that is not predetermined in the latter case, the CPU 121 may calculate the payout based on the number of coins on the winning form table. The winning form table is referred in order to control the stops of the reels 13L, 13C and 13R and to check the completion of a winning combination after the reels stop.

Figure 1:
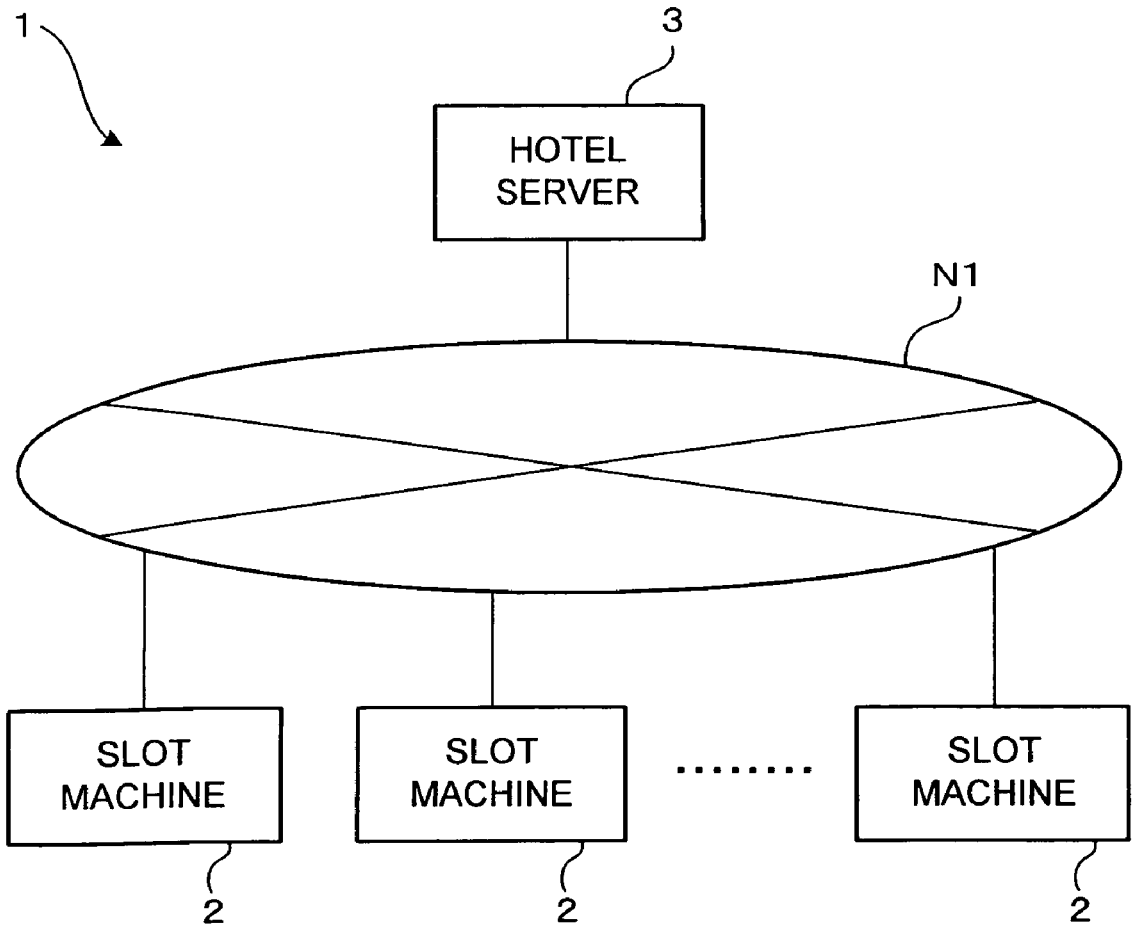
FIG. 1 is a block diagram showing an entire construction of a game system according to a first embodiment of the invention.

The RAM 123 stores game rate data, which is transmitted from the hotel server 3 (see FIG. 1). The current number-of-deemed-coins data credit to a player is also stored in the RAM 123.

The elements for random number sampling include a clock pulse generating circuit 124 which generates a reference clock pulse, a frequency divider 125, a random number generator 126 and a random number sampling circuit 127 and are connected to the CPU 121. The random number generator 126 generates random numbers belonging to a predetermined range, and a random number of the random numbers is sampled by the random number sampling circuit 127.

The CPU 121 is connected, via the output end of the I/O port, to a motor drive circuit 41, a sound source IC 51, a hopper drive circuit 42, an image control circuit 171 and a lamp drive circuit 55. The motor drive circuit 41 drives stepping motors 59L, 59C and 59R to rotate the reels 13L, 13C and 13R. The sound source IC 51 drives a power amplifier 52 serving as an amplifier which amplifies a sound output from the speaker 53 within the cabinet 12. The hopper drive circuit 42 drives a hopper 40 to deposit and payout a coin. The image control circuit 171 controls images to be displayed on the main display 15 and sub display 16 based on a control command from the CPU 121. The lamp drive circuit 55 drives lamps including the error lamp 33.

The image control circuit 171 includes an image control program ROM, an image control CPU, an image control work RAM and an image control IC. The microcomputer 120 receives notice information data from a notice information distributing server (not shown) through a communication board 201 and transmits an image display signal based on the data to the image control circuit 171. The image control CPU of the image control circuit 171 determines images to be displayed on the main display 15 and sub display 16 based on an image display signal and in accordance with an image control program stored within the image control program ROM. The image control circuit 171 is also connected to the touch panel 61 on the main display 15 and locates the position of the coordinates touched by a player on the touch panel 61 and may change the position and/or size of notice information displayed on the main display 15, switch and display the notice information displayed on the main display 15 onto the sub display 16 or switch and display the notice information displayed on the main display 15 and sub display 16.

The notice information may be information, which is not directly related to a game, such as information on an event to be held within the gaming place and advertisement information. The notice information distributing server is connected to each of the slot machines 2 through a communication unit such as a local area network established within the gaming place and the Internet.

The CPU 121 is connected, via the input end of the I/O port, to a coin sensor 22S, the error switch 23, the help switch 24, the spin switch 25, the cash-out switch 26, the BET switch 27, the maximum BET spin switch 28, the repeat BET spin switch 29, a reel position detecting circuit 44 and a payout completion detecting circuit 46. The coin sensor 22S detects a coin inserted through the coin insertion slot 22 (see FIG. 2). The payout completion detecting circuit 46 detects the completion of payout based on the detection signal from a coin sensor 45.

The CPU 121 is further connected to the card reader 200 and the communication board 201. The communication board 201 not only communicates with the notice information distributing server as described above but also communicates with the hotel server 3 (see FIG. 1). More specifically, the game rate data output by the hotel server 3 is transmitted to the microcomputer 120 through the communication board 201.

Now, operations of the elements in the controller during processing relating to a game will be described.

First of all, in response to a signal from one of the spin switch 25, maximum BET spin switch 28 and repeat BET spin switch 29, the CPU 121 gives a signal for driving the stepping motors 59L, 59C and 59R to the motor drive circuit 41 so that the rotations of the reels 13L, 13C and 13R can be started.

The CPU 121 counts the number of driving pulses supplied from the motor drive circuit 41 to the stepping motors 59L, 59C and 59R and writes the number-of-pulses data in a predetermined area of the RAM 123. A reset pulse occurs for one rotation of each of the reels 13L, 13C and 13R, and, when the reset pulse is input to the CPU 121 through the reel position detecting circuit 44, the CPU 121 changes the number-of-driving-pulses data written in the RAM 123 to zero (0). Thus, the data corresponding to the position of each of the reels 13L, 13C and 13R within one rotation is stored in the RAM 123.

In a timing after the start of the rotations of the reels 13L, 13C and 13R, the random number sampling circuit 127 randomly samples a random number from random numbers generated by the random number generator 126. Then, the CPU 121 determines which range the sampled random number belongs to on the lottery table stored in the ROM 122. The CPU 121 determines a win if the sampled random number belongs to a predetermined range and stops the reels 13L, 13C and 13R such that a predetermined winning combination can be completed on the activated line 18. More specifically, the CPU 121 controls the motor drive circuit 41 with reference to the position data of the reels 13L, 13C and 13R, symbol arrangement table and stop control table, which are stored in the RAM 123 to stop the driving the stepping motors 59L, 59C and 59R.

If a player presses the cash-out switch 26 when a winning combination is completed on the activated line 18 as a result of the stop of the reels 13L, 13C and 13R, the CPU 121 transmits a payout signal to the hopper drive circuit 42 to drive the hopper 40 so that a coin is paid out. The coin sensor 45 then detects the number of coins paid out by the hopper 40 and, when the detected number of coins reaches a predetermined number, inputs the detection signal to the payout completion detecting circuit 46. The detection signal is transmitted to the CPU 121 through the payout completion detecting circuit 46, and the CPU 121 stops the driving of the hopper 40 through the hopper drive circuit 42 and finishes the payout of coins.

Next, a construction of the hotel server 3 will be described in detail with reference to FIG. 6.

Figure 6:
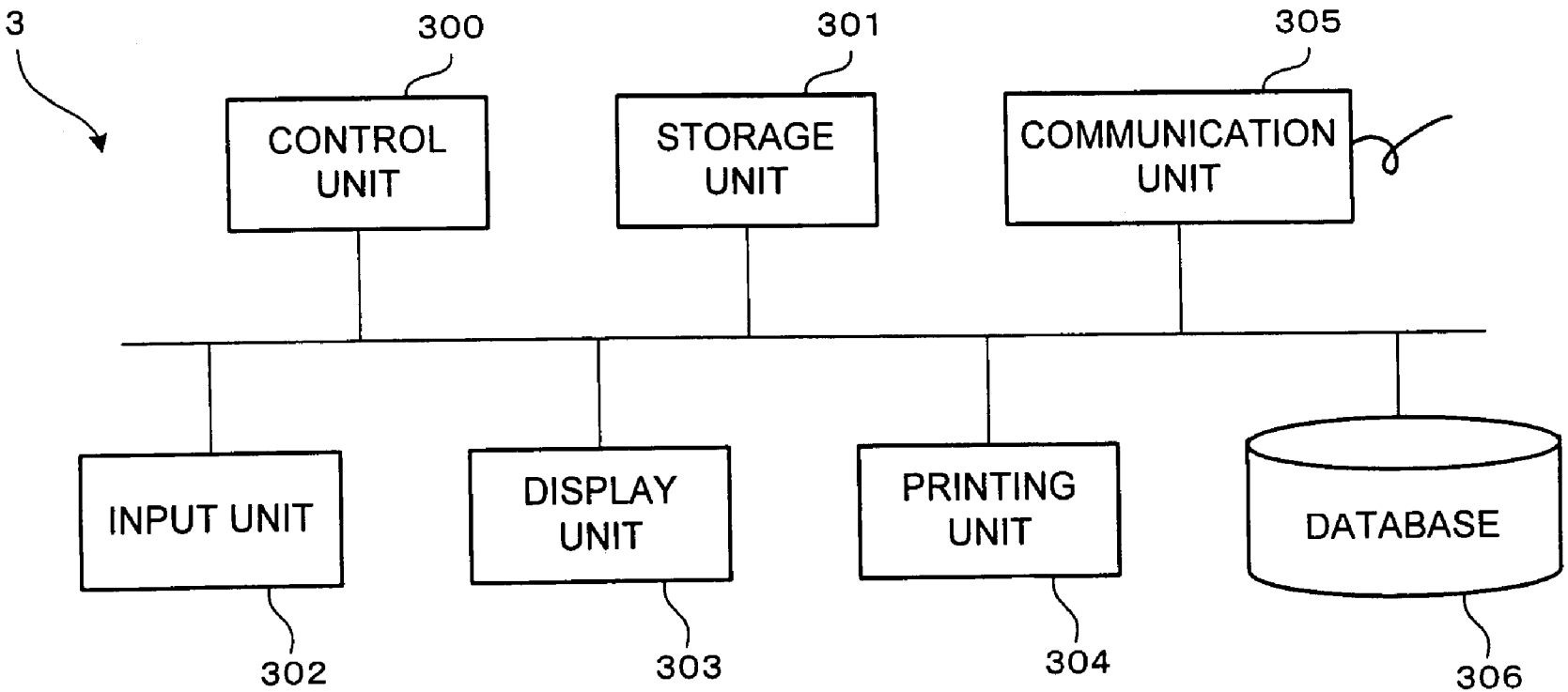
FIG. 6 is a block diagram showing a construction of a hotel server included in the game system according to the first embodiment.

The hotel server 3, which may be a host computer of the hotel, includes, as shown in FIG. 6, a control unit 300, a storage unit 301, an input unit 302, a display unit 303, a printing unit 304, a communication unit 305 and a database 306. The control unit 300 may be a CPU. The storage unit 301 may be a ROM or RAM. The input unit 302 may be a keyboard and/or a mouse. The display unit 303 may be a liquid crystal display. The printing unit 304 may be a printer. The database 306 may be a large-capacity storage device such as an HDD. The control unit 300 executes a program stored in the storage unit 301 with reference to data stored in the database 306 and the like. The communication unit 305 has a function of communicating with the network N1. The database 306 stores game rate data to be transmitted to the slot machines 2.

More specifically, the database 306 stores a table having correspondences between room numbers and hotel charges and a table having correspondences between hotel charges and game rates (e.g., one dollar if the hotel charge is high, 50 cents if middle and 25 cents if low). Furthermore, an especially high game rate (such as 10 dollars) may be set, and the especially-high game rate may be associated with VIP customers.

Next, game rate setting processing in the game system 1 will be described with reference to FIG. 7.

During stand-by when no game is played in each of the slot machines 2, a message that a room key may be inserted through the card reader 200 to start a game is displayed on the main display 15 and/or sub display 16. A player who desires to start playing a game inserts his/her room key through the card reader 200 (S100). Then, the room number is read (S101).

The slot machine 2 transmits the room number obtained through the card reader 200 to the hotel server 3 (S102). The hotel server 3 extracts game rate data, based on the room number transmitted from the slot machine 2 and with reference to the table of the database 306, and then transmits the game rate data to the slot machine 2 (S201). The slot machine 2 receives the game rate data from the hotel server 3 (S103) and, based on the data, updates the game rate stored area in the RAM 123 to set the game rate (S104). Then, the game rate setting processing ends.

After the end of the game rate setting processing, the slot machine 2 performs processing relating to a game, e.g., win determination and payout upon completion of a winning combination, based on the game rate.

As described above, according to the first embodiment, a player just have to insert his/her room key through the card reader 200 (S100). In other words, the setting of a game rate can be easily performed without requiring a player to perform a complicated operation. Therefore, the problem can be reduced that the game rate setting function is useless especially when a player is a beginner or foreigner and is not familiar with the operations of the gaming machine.

Furthermore, according to this embodiment, a game rate for each player is set based on the identification information, which is a room number in the embodiment. Thus, the player's satisfaction can be enhanced, and the sales in the gaming place can also be efficiently enhanced.

The slot machine 2 has the card reader 200 and receives a room number data from the room key that a player carries through the card reader 200. Thus, the player's identification information can be received easily.

The slot machine 2 transmits received room number as a player identification information to the hotel server 3, which can store a large amount of data (S102) and receives game rate data from the hotel server 3 (S201). In a case a slot machine independently sets a game rate based on identification information without the hotel server 3, a table having a correspondence between player identification information and game rates, for example, has to be stored in the slot machine, however, which is not required in this embodiment. Thus, the construction of the slot machine 2 can be simpler.

When the slot machine 2 is provided in a gaming place within a hotel, the room key of the hotel is used to obtain the identification information of a player and the hotel server 3 is used to receive his/her game rate data so that the game system can be constructed easily and at low costs.

Next, a game system according to a second embodiment of the invention will be described with reference to FIG. 8. The same reference numerals are given to the same components of the first embodiment, and the repetitive description will be omitted herein.

Figure 8:
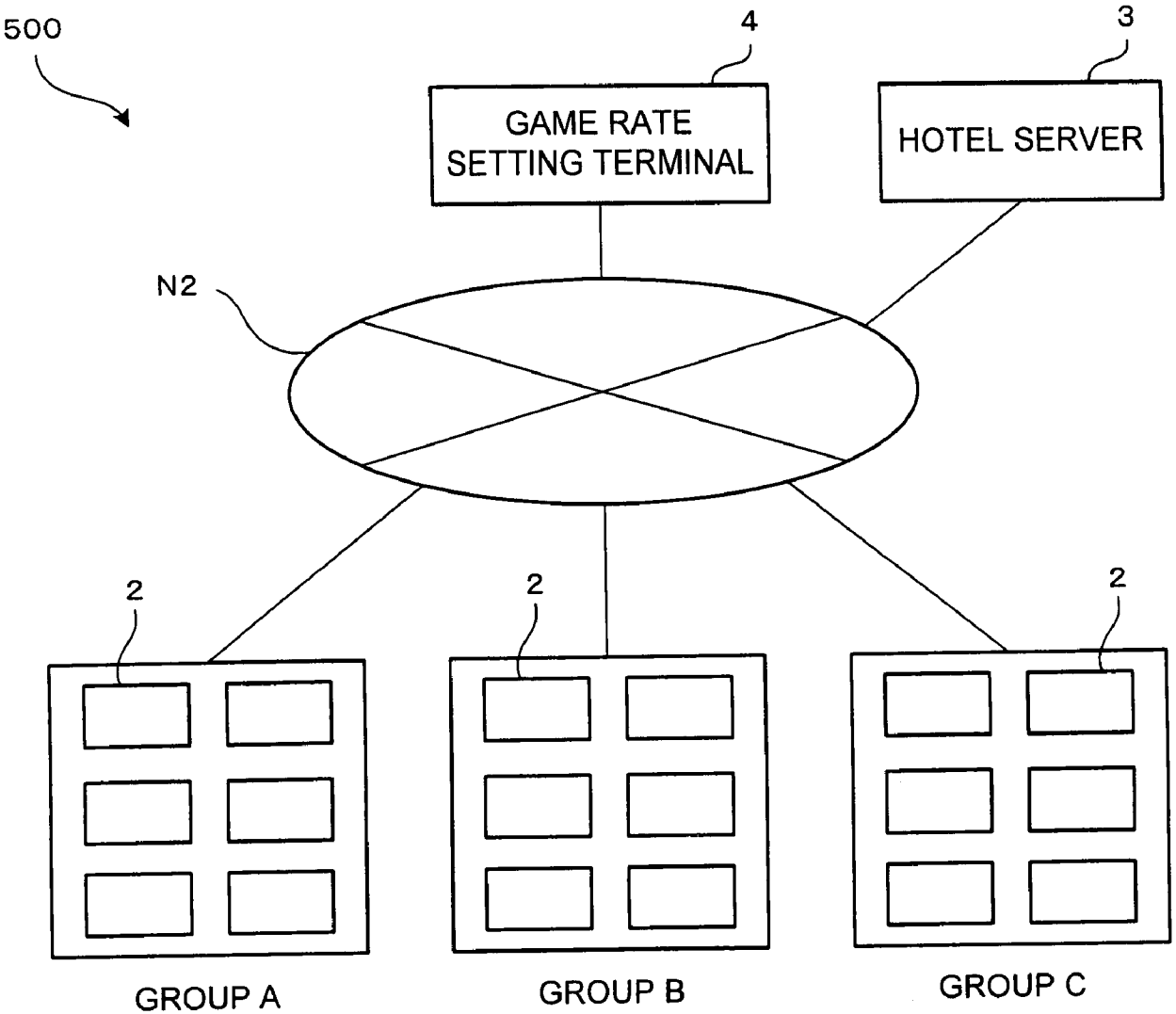
FIG. 8 is a block diagram showing an entire construction of a game system according to a second embodiment of the invention.

As shown in FIG. 8, a game system 500 of this embodiment includes a game rate setting terminal 4 in addition to the hotel server 3 and the slot machines 2. The slot machines 2 are divided in three groups A, B and C, based on the sections that the slot machines 2 are placed, the types of the slot machines 2 and in consideration of the game rate setting functions, which will be described later. Each of the groups A, B and C of the slot machines 2 is connected to the hotel server 3 and game rate setting terminal 4 via a network N2.

Figure 10:
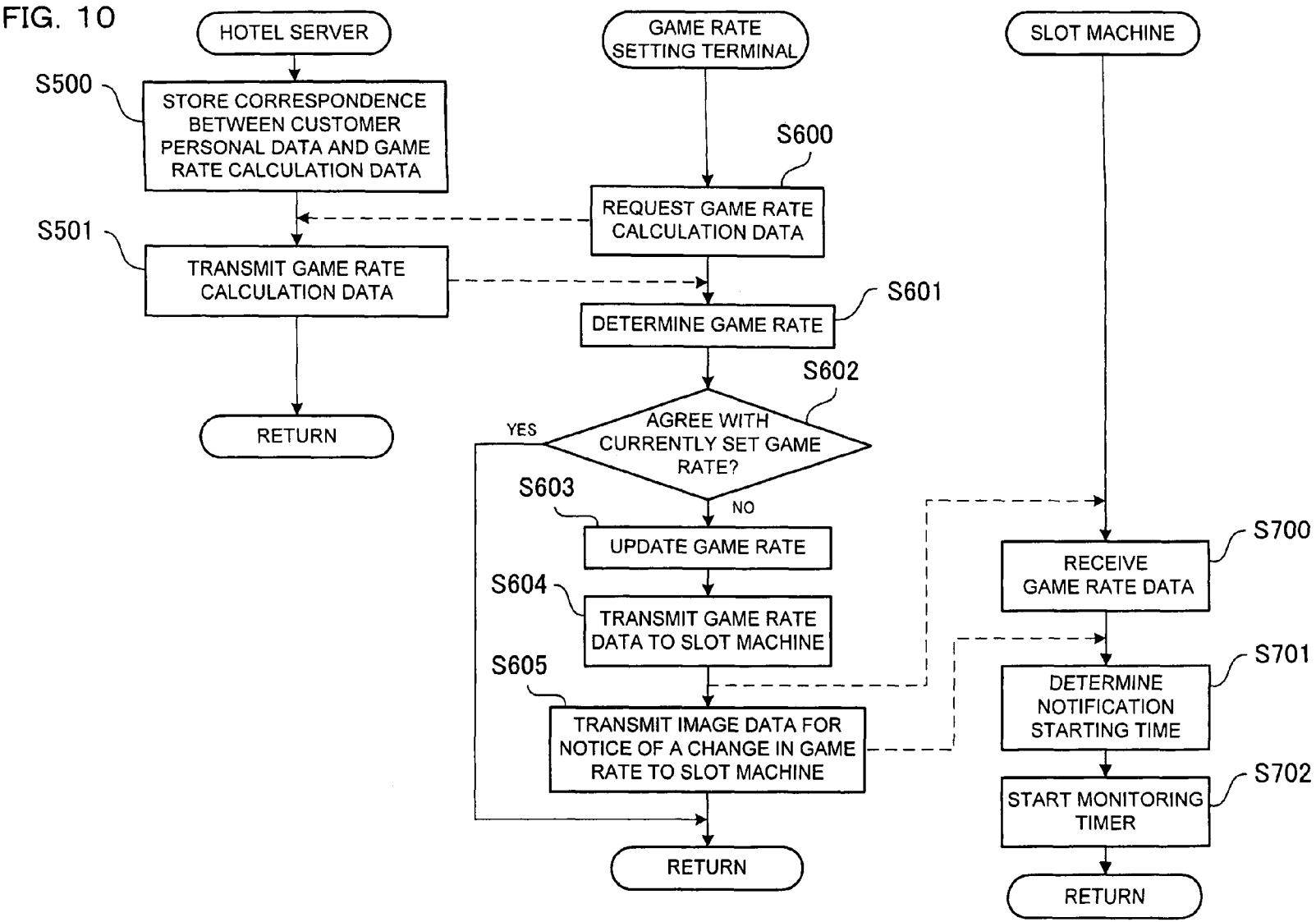
FIG. 10 is a flowchart showing game rate setting processing in the game system according to the second embodiment.

The ROM 122 (see FIG. 5) of the slot machine 2 according to this embodiment stores a game rate-data receiving program shown in FIG. 10, and the RAM 123 of the microcomputer 120 stores game rate data to be transmitted from the game rate setting terminal 4 in S604 in FIG. 10.

Figure 9:
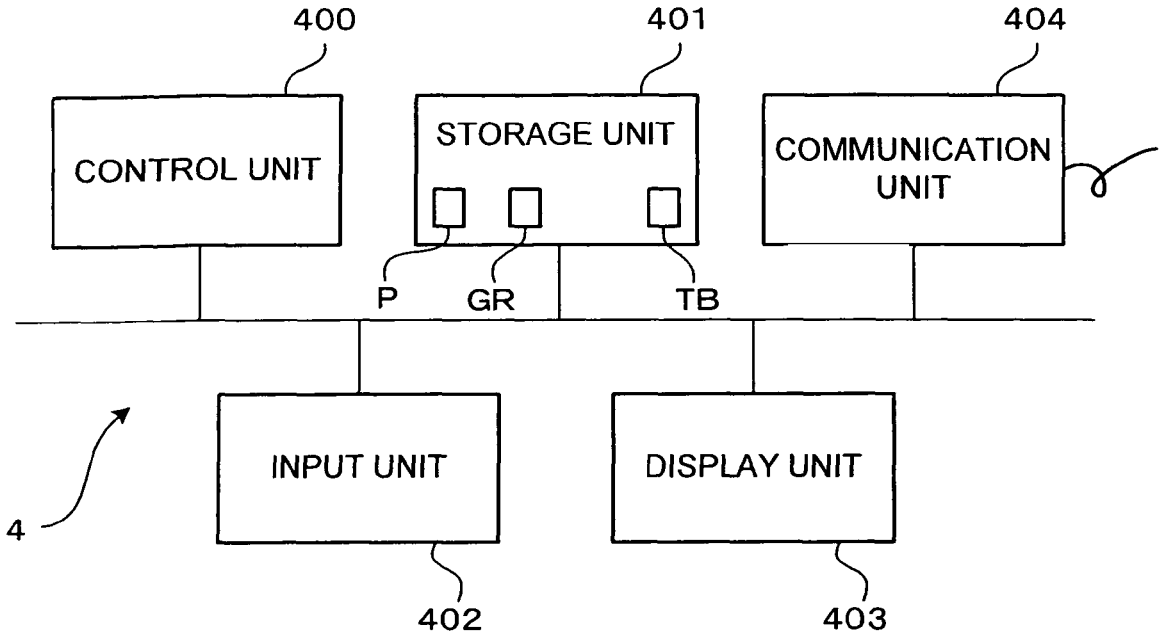
FIG. 9 is a block diagram showing a construction of a game rate setting terminal included in the game system according to the second embodiment.

The game rate setting terminal 4 is an information processing apparatus such as a personal computer having a communication function and includes, as shown in FIG. 9, a control unit 400, a storage unit 401, an input unit 402, a display unit 403 and a communication unit 404. The control unit 400 may be a CPU. The storage unit 401 may be a ROM or RAM. The input unit 402 may be a keyboard and/or a mouse. The display unit 403 may be a liquid crystal display. The control unit 400 executes a program stored in the storage unit 401 with reference to data and the like stored in the storage unit 401. The communication unit 404 is capable of communicating with the network N2. The storage unit 401 may store a game rate setting program P shown in FIG. 10, a game rate GR currently set for each of the groups A, B and C of the slot machines 2, a game rate calculation data/game rate conversion table TB shown in FIG. 11 and the like.

According to this embodiment, the database 306 of the hotel server 3 (see FIG. 6) stores personal data such as history of hotel usage, occupation, the type of credit card used, charge division of the room under reservation or being used, and the like of a customer staying at or reserving a room in a hotel. The database 306 further stores a table having a correspondence between customer's personal data and game rate calculation data. For example, an equation using personal data as a parameter may be preset therein such that the personal data can be assigned to the equation to obtain game rate calculation data when a receptionist of the hotel inputs personal data of a customer to the hotel server 3 upon reservation or check-in. One game rate calculation data may be used for a group of staying customers or each different game rate calculation data may be used for each of customers.

Next, game rate setting processing in the game system 500 will be described with reference to FIG. 10. According to this embodiment, the game rate is set for each of the groups A, B and C of the slot machines 2. That is, one game rate is set for one group.

The control unit 400 of the game rate setting terminal 4 starts the game rate setting program shown in FIG. 10 at a predetermined time during non-business hours of a gaming place such as once in a period from the check-out time to the check-in time of the hotel or simultaneously with the start of the terminal 4 by a staff member of the gaming place.

The game rate setting terminal 4 first requests game rate calculation data to the hotel server 3 (S600).

A correspondence between customer's personal data and game rate calculation data is stored in the hotel server 3 upon reservation or check-in as described above (S500). Then, when the game rate calculation data is requested from the game rate setting terminal 4 (S600), the game rate calculation data for each customer is transmitted to the game rate setting terminal 4 (S501).

The game rate setting terminal 4 determines a game rate for each of the groups A, B and C of the slot machines 2 with reference to the game rate calculation data/game rate conversion table TB (see FIG. 11) stored in the storage unit 401 based on the received game rate calculation data (S601). In this embodiment, three levels of "High", "Middle" and "Low" of game rate calculation data may be transmitted from the hotel server 3, and the game rate setting terminal 4 determines a game rate for each of the groups A, B and C based on the proportions of "High", "Middle" and "Low".

After the game rate is determined, the game rate setting terminal 4 determines whether the determined game rate agrees with the currently set game rate GR (see FIG. 9) or not (S602).

The game rate setting terminal 4 exits from the sub-routine if the game rate setting terminal 4 determines that the determined game rate agrees with the currently set game rate GR (S602: YES).

The game rate setting terminal 4 updates the game rate GR (S603) if the game rate setting terminal 4 determines that the determined game rate does not agree with the currently set game rate GR (S602: NO). Then, the game rate setting terminal 4 creates game rate data including the game rate GR and transmits it to the slot machine 2 (S604). Furthermore, the game rate setting terminal 4 forms image data for notifying the change in game rate and transmits it to the slot machine 2 (S605) and exits from the sub-routine.

The game rate data to be transmitted from the game rate setting terminal 4 to the slot machine 2 in S604 includes not only the game rate determined in S601 but also time data corresponding to the time for setting the game rate. The game rate setting terminal 4 may transmit the game rate data only to a group of the slot machines 2 requiring changing the game rate, i.e., a group where the game rate determined in S601 is different from the currently set game rate GR. Furthermore, the game rate setting terminal 4 may transmit game rate data to the slot machine 2 by using a broadcast communication function.

Furthermore, when a special server for forming image data is provided in a gaming place, the server instead of the game rate setting terminal 4 may form image data for notifying a change in game rate and transmit it to the slot machine 2.

After receiving the game rate data from the game rate setting terminal 4, the slot machine 2 starts a game rate-data receiving program shown in FIG. 10. The slot machine 2 first receives game rate data and stores the received game rate data in the RAM 123 (S700). Next, the slot machine 2 extracts time data from the received game rate data and determines a starting time for notifying the change in game rate based on the time data (S701). The slot machine 2 then starts a notification starting time monitoring timer and a game rate setting time monitoring timer such as a CPU soft timer (S702) and exits from the sub-routine.

For example, if the time when a game rate is set is 8:00 PM, 7:00 PM, which is one hour before, may be determined as the notification starting time and display the message "The game rate will be changed at 8:00 PM" on the main display 15 or sub display 16 of the slot machine 2 from 7:00 PM. The notification starting time may be determined by the game rate setting terminal 4 and be transmitted to the slot machine 2 as a piece of the game rate data in S604.

Figure 12:
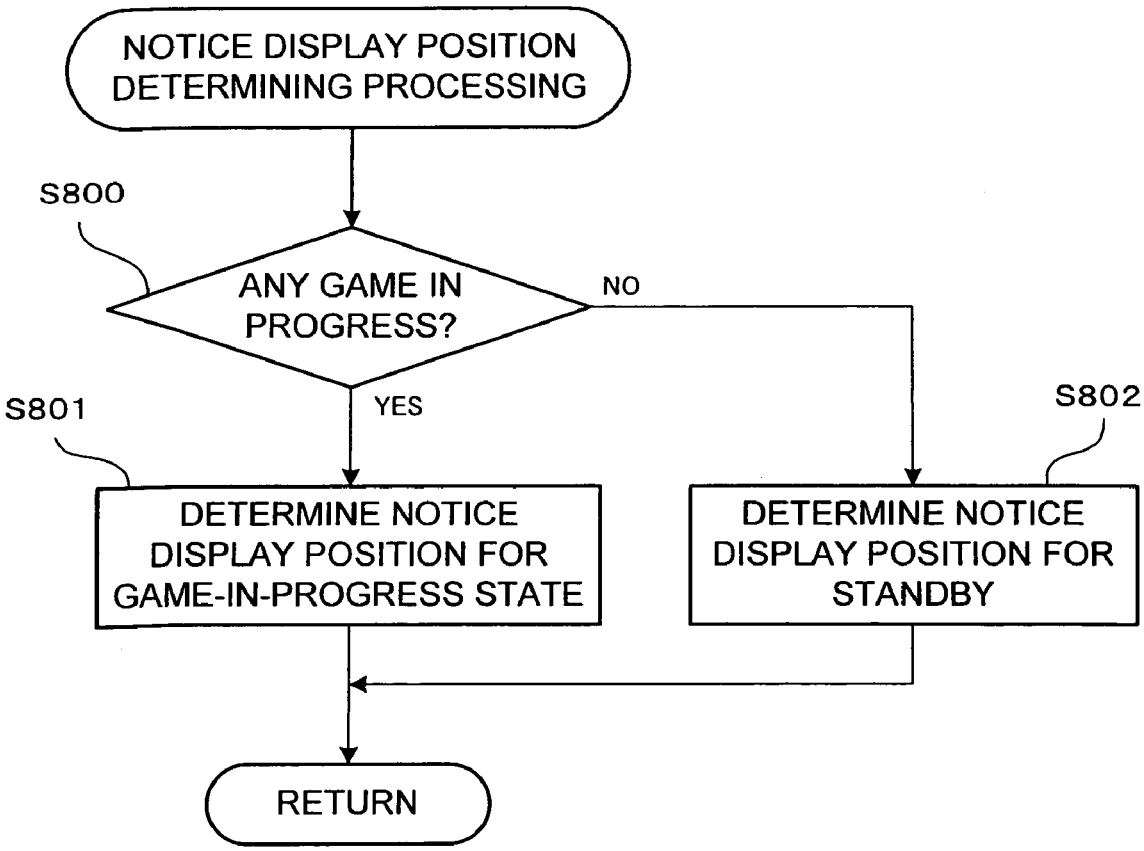
FIG. 12 is a flowchart showing notice display position determining processing in a slot machine included in the game system.

When the notification starting time monitoring timer times up, that is, when it comes to the notification starting time, the slot machine 2 starts the notice display position determining processing shown in FIG. 12. The slot machine 2 first determines whether any game is in progress or not based on whether the number of currently deposited real coins or deemed coins is zero or not (S800).

Figure 14:
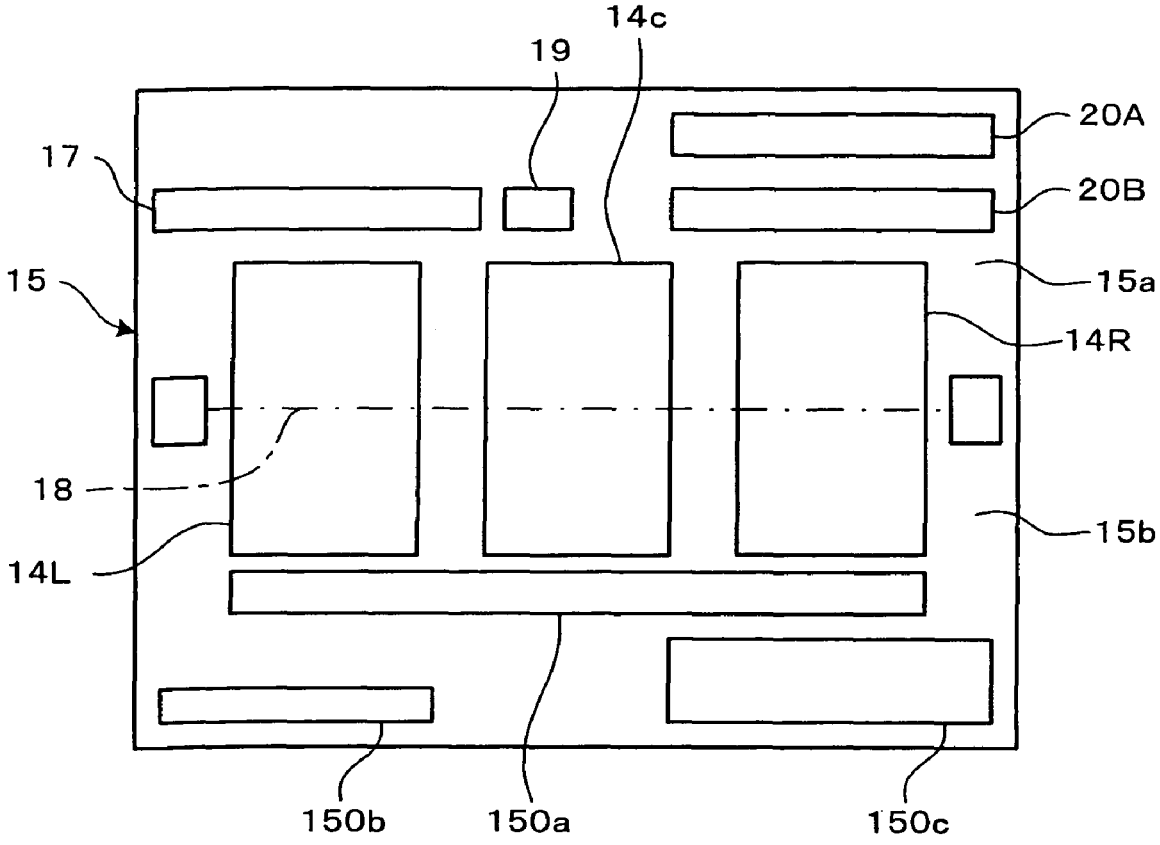
FIG. 14 is a diagram showing a notice displayed position example during a game.

If some game is in progress (S800: YES), the slot machine 2 determines a notice display position for the game-in-progress state (S801). The notice display position for the game-in-progress state may be included in any one of the sub display 16 and display areas 150*a*, 150*b* and 150*c* (see FIG. 14) in the substantially lower half 15*b*, i.e., in an area which does not display information relating to the proceeding of a game, of the main display 15.

If no game is in progress (S800: NO), the slot machine 2 determines the notice position for standby (S802). The notice display position for standby may be the entire area of the main display 15.

The display position is switched when any game is started during a notification period (e.g., when a game is started before 8:00 PM though the slot machine 2 is on standby at 7:00 PM in this case) or when a game is interrupted (e.g., when a game ends before 8:00 PM though the game is in progress at 7:00 PM in this case).

Figure 13:
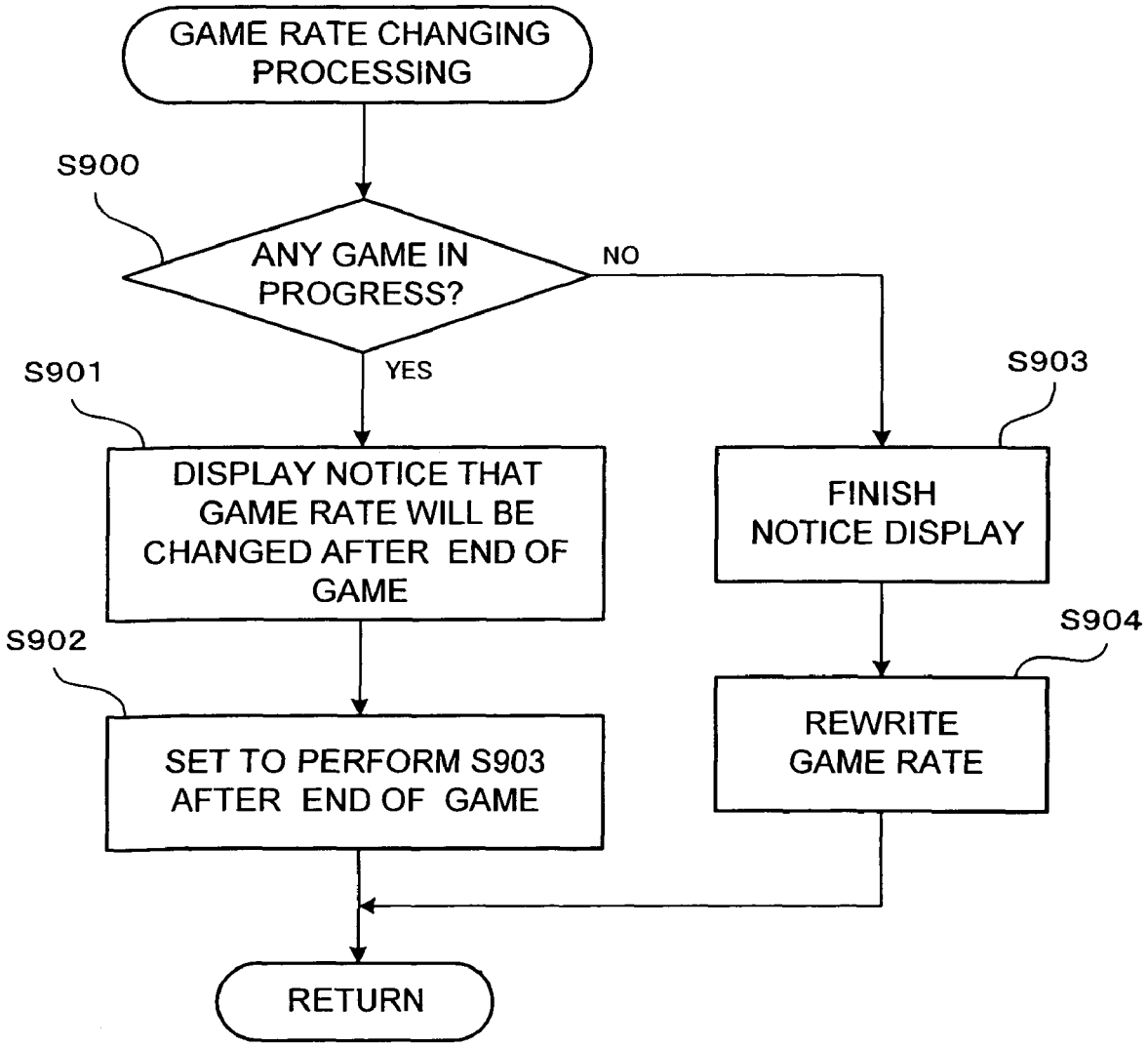
FIG. 13 is a flowchart showing game rate changing processing in the slot machine.

When the game rate setting time monitoring timer times up, that is, reaches a set time, the slot machine 2 starts the game rate changing processing in FIG. 13. The slot machine 2 first determines whether any game is in progress or not (S900) like S800.

If some game is in progress (S900: YES), the slot machine 2 displays the notice that the game rate will be changed after the end of the game (S901). Then, S903, which will be described later, is set to be performed after the end of the currently played game (S902).

If no game is in progress (S900: NO), the slot machine 2 finishes the notice display (S903). Then, the slot machine 2 rewrites the value of the game rate recorded in the slot machine 2 to the game rate GR included in the game rate data received from the game rate setting terminal 4 (S904) and exits from the sub-routine.

As described above, according to the second embodiment, a game rate can be set easily without requiring a player or a staff member in a gaming place to perform any complicated operation like the first embodiment.

Especially in this embodiment, a game rate can be set in accordance with the class of a party of tourists during a time zone when the party of tourists plays games since the time data corresponding to the time for setting a game rate is included in game rate data transmitted from the game rate setting terminal 4. Furthermore, in this embodiment, a game rate of the slot machine 2 can be set in accordance with the class of customers of a hotel each day without requiring a player to cause a recording medium such as a room key to be read by the card reader 200 like the first embodiment and without requiring a staff member of the gaming place to operate the slot machine 2.

The notice of a change in game rate is displayed on the display, i.e., main display 15 or sub display 16, of the slot machine 2 before the time for setting a game rate so that player's attention can be called and the player's interest in a game can be more increased.

If some game is in progress at the game rate setting time (S900: YES), the setting of a game rate is set to be performed after the end of the game (S902) so that the problem is avoided that the proceeding of the currently played game can be prevented.

The game rate set as described above can be changed by a player. For example, before the start of a game, a set game rate may be displayed on the main display 15, and a player may be allowed to select whether the game rate may be left as it is or not. Then, the player may change the game rate through a select switch or the like provided in the slot machine 2.

A player may be allowed to select one of the game rates. For example, a VIP customer may select one of one dollar and 50 cents, and a general customer may select one of 50 cents and 25 cents.

In S103 (see FIG. 7) of the first embodiment, the game rate data to be received by the slot machine 2 is not limited to data of a game rate but may be data for determining a game rate. When data for determining a game rate is received in S103 instead of the game rate itself, the slot machine 2 determines the game rate based on the data. In this case, the RAM 123 of the slot machine 2 may store a table having correspondences between hotel charges and game rates.

The recording medium for identification information used in the first embodiment may be any one of a credit card issued by a credit card company, a membership card issued by a gaming place, a cellular phone terminal carried by a player and the like other than a room key of a hotel. If the recording medium is a credit card issued by a credit card company, a computer that manages members of the credit card company may be used instead of the hotel server 3. If the recording medium is a membership card issued by a gaming place, a computer that manages the members thereof may be used instead of the hotel server 3. If the recording medium is a cellular phone terminal carried by a player, an infrared near-distance wireless communication construction or the like may be provided therein to obtain identification information of a player through the near-distance wireless communication with the cellular phone terminal.

Figure 7:
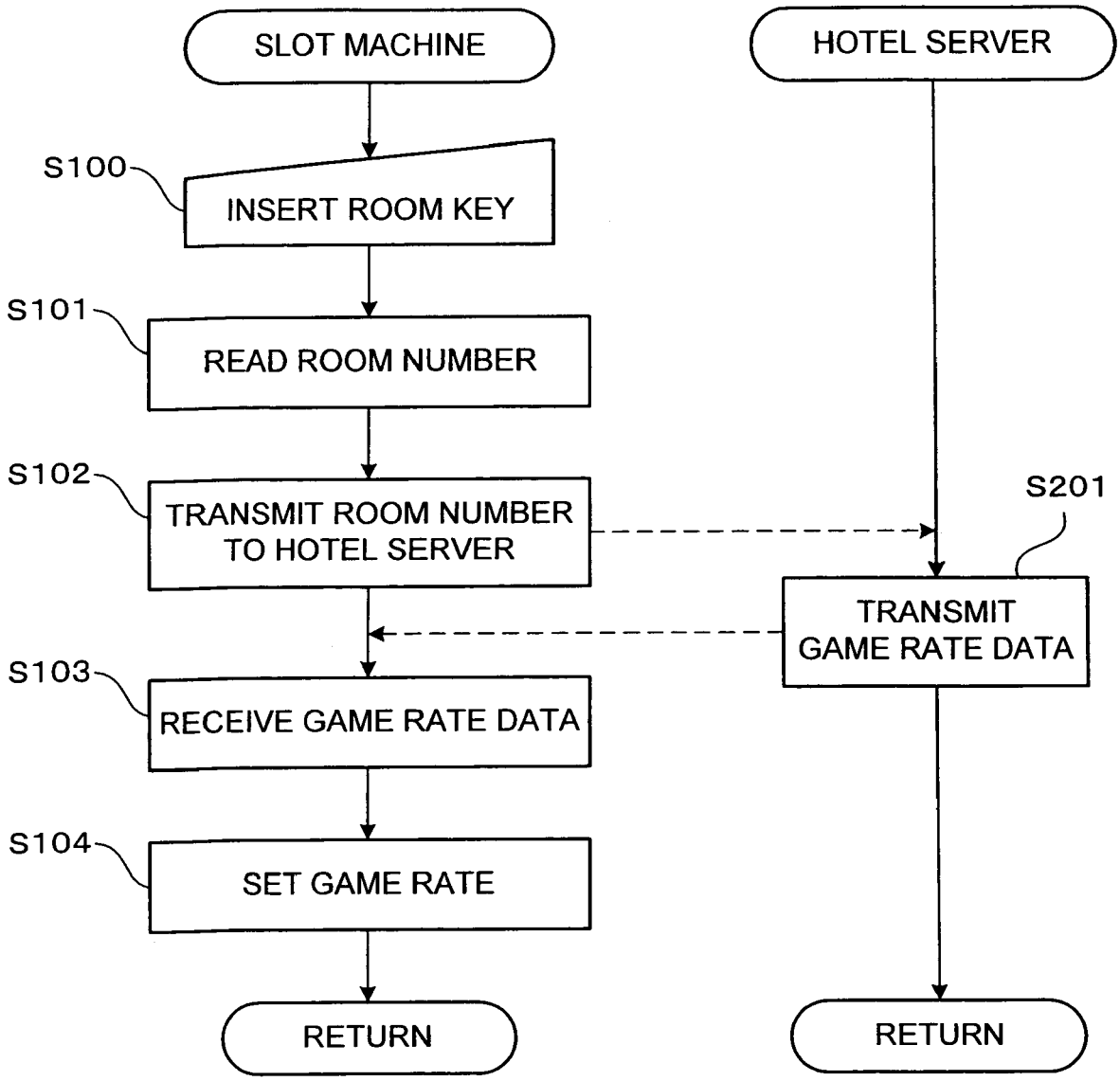
FIG. 7 is a flowchart showing a game rate setting processing in the game system according to the first embodiment.

The slot machine 2 in the first embodiment may obtain identification information of a player through an input operation on the touch panel 61 on the main display 15 instead of the implementation of S100 and S101 (see FIG. 7).

Furthermore, in S102, the slot machine 2 may transmit not only the room number but also other information to the hotel server 3. For example, after a room number is read in S101, a message for prompting to input a password is displayed on the main display 15 and/or sub display 16, and the input password may also be transmitted to the hotel server 3.

The slot machine 2 obtains game rate data from the hotel server 3 in the first embodiment. However, a table having correspondences between player identification information and game rates or the like may be stored in the slot machine 2 or a game rate may be recorded in a recording medium carried by a player, such as a room key, so that the game rate may be determined by the slot machine 2 independently without using the hotel server 3.

In the first embodiment, the card reader 200 may be placed within the cabinet 12 instead of being externally provided to the cabinet 12.

The game system 500 of the second embodiment may further include a large-screen liquid crystal display visible to players of all of the slot machines 2 and connecting to a network N, and an image corresponding to notice image data transmitted from the game rate setting terminal 4 may be displayed on the liquid crystal display.

In the second embodiment, a game rate may be set in accordance with the time zone or season instead of the class of customers. For example, a game rate may be raised more during the time zone from 8:00 PM to 10:00 PM than the other time zones or may be raised more on Christmas Day than the other days.

Though one game rate is set for each of the groups A to C in the second embodiment, the invention is not limited thereto. Different game rates may be set for slot machines 2 in one group. Alternatively, a game rate may be set in different timings for the groups A to C.

The slot machines 2 included in the game system 500 do not have to be divided into groups.

In the second embodiment, the notification of a change in game rate is not limited to the display on the displays 15 and/or 16 of the slot machine 2, but a change in game rate may be notified by voice.

It is not limited that the currently deposited coin or coins is or are paid out at the end of a game, but the amount equivalent to the coin or coins may be stored in a recording medium that records identification information and may be adjusted upon check-out of a hotel. Alternatively, the slot machine 2 may further include a receipt printing unit, and the balance may be printed on a receipt and may be converted into money at a fair adjustment office.

When the slot machine 2 has not only one activated line 18 but also activated lines, a different game rate may be set for each of the activated lines. For example, the game rate of a horizontal activated line and the game rate of an inclining or declining activated line may be different.

Each of the networks N1 and N2 may have a bus, ring, mesh or daisy-chain connection. The components of the game system 1 and 500 including the slot machines 2 and hotel server 3 may be connected by a different network depending on the combination thereof or may be connected via a dedicated line instead of the networks N1 and N2. The slot machines 2 grouped into the groups A, B and C in the second embodiment may be connected to the network N2 via a local network for each of the groups.

An effect image relating to a game may be shown in the entire area of the main display 15 or may be partially shown on the main display 15 like this embodiment.

The main display 15 and sub display 16 of each of the slot machines 2 include liquid crystal display devices 64 and 74 herein but may include a CRT, a plasma display, and the like instead of the liquid crystal display devices 64 and 74. The sub display 16 is placed in the upper part of the cabinet 12 herein but may be placed on the left or right side of the main display 15. Alternatively, another sub display may be further provided.

The random number generation and sampling may be performed by computing in the CPU 121 within the microcomputer 120 instead of the circuits 124, 125, 126 and 127 for random number sampling.

Though a slot machine is applied as a gaming machine in the embodiments, but a gaming machine for a different game may be applied instead. The gaming machine may be a gaming machine by which players can enjoy games simultaneously, such as a roulette machine, or may be a gaming machine by which each player can enjoy games, such as a pachi-slot machine. Furthermore, the gaming machine is not limited to be placed in a hotel.

The game rate may include a medal to be used in a pachi-slot machine in addition to a coin or coins.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A game system comprising:

a plurality of gaming machines each belonging to one of a plurality of groups; and an external device configured to be in communication with each of the plurality of gaming machines, wherein each of the plurality of gaming machines include a reader configured to read identification information identifying a player and a game controller configured to:

transmit the identification information read by the reader to the external device;

receive game rate data from the external device based on the identification information, wherein the game rate data is a fee for playing a single game or a fee to be bet on a single line;

automatically set a game rate from a plurality of available game rate settings without receiving a user input to set the game rate based on the received game rate data; and execute a process according to a game based on the set game rate, wherein the process results in a payout in coins, a number of which is calculated by multiplying the set game rate by a number corresponding to a winning symbol combination, and wherein the external device includes a controller configured to execute a game rate determining program, and by executing the game rate determining program:

receive the identification information from each of the plurality of gaming machines;

select one of a plurality of levels based on the identification information received from each of the plurality of gaming machines;

determine a ratio of a number of the plurality of gaming machines of the plurality of levels corresponding to each of the plurality of groups;

select a game rate for each of the groups based on the ratio; and transmit, to each of the plurality of gaming machines, the selected game rate data including the selected game rate corresponding to a respective one of the plurality of groups to which each gaming machine belongs.

2. The game system according to claim 1, wherein the external device further comprises:

a database configured to store a table that associates the identification information with the data for determining a game rate and a table that associates the levels with the game rate; and the controller is configured to:

extract, from the database, the data for determining the game rate associated with the received identification information;

determine a level by a calculation using the extracted data for determining the game rate;

extract, from the database, the game rate associated with the level; and transmit, to each of the plurality of gaming machines, game rate data including the extracted game rate.

3. The game system according to claim 1, wherein:

each of the plurality gaming machines are configured to receive, from a room key, data identifying a room number of a hotel as the identification information identifying a player; and the external device includes a computer configured to manage data corresponding to guests staying at the hotel.

4. A game system comprising:

a plurality of gaming machines each belonging to one of a plurality of groups; and an external device configured to be in communication with each of the plurality of gaming machines, wherein each of the plurality of gaming machine include:

a user interface configured to receive an input from a player;

a reader configured to read identification information identifying a player; and a game controller configured to:

transmit the identification information read by the reader to the external device;

receive game rate data from the external device, wherein the game rate data is a fee for playing a single game or a fee to bet on a single game;

automatically set a game rate from a plurality of available game rate settings without receiving a user input to set the game rate based on the game rate data received from the external device; and execute a process according to a game based on the set game rate, wherein the process results in a payout in coins, a number of which is calculated by multiplying the set game rate by a number corresponding to a winning symbol combination, and wherein the external device includes a controller configured to execute a game rate determining program, and, by executing the game rate determining program:

receive the identification information from each of the plurality of gaming machines;

select one of a plurality of levels for each set of identification information;

determine a ratio of a number of the plurality of gaming machines of the plurality of levels corresponding to each of the plurality of groups;

select the plurality of game rates for each of the respective groups from plural game rates based on the ratio; and transmit, to each of the plurality of gaming machines, the selected game rate data including the selected game rate corresponding to a respective one of the plurality of groups to which each gaming machine belongs.

5. A game system, comprising:

a plurality of gaming machines each belonging to one of a plurality of groups; and an external device configured to be in communication with each of the plurality of gaming machines, wherein each of the plurality of gaming machines include:

a reader configured to read identification information identifying a player; and a game controller configured to:

transmit the identification information read by the reader to the external device, receive game rate data from the external device, wherein the game rate data is a fee for playing a single game or a fee to bet on a single game, automatically set a game rate from a plurality of available game rate settings without receiving a user input to set the game rate based on the game rate data received from the external device at a time corresponding to time data included in the received game rate data, and execute a process according to a game based on the set game rat;

wherein the process results in a payout in coins, a number of which is calculated by multiplying the set game rate by a number corresponding to a winning symbol combination; and the external device includes:

a database configured to store data for determining a game rate; and a controller configured to:

receive the identification information from each of the plurality of gaming machines, select one of a plurality of levels for each identification information based on the data for determining a game rate stored in the database, determine a ratio of a number of the plurality of gaming machines of each of the plurality of levels corresponding to each of the plurality of groups, select a game rate for each of the groups based on the ratio, determine a time at which the game rate is set by each of the plurality of gaming machines, and transmit, to each of the gaming machines each belonging to one of the plurality of groups, the game rate data selected for each group, the game rate data including the selected game rate and the time data corresponding to the time at which the game rate is set by each of the plurality of gaming machines.

6. The game system according to claim 5, wherein, each of the plurality of gaming machines further comprise:

a display configured to display a notification that the game rate will be changed prior to changing the game rate.

7. The game system according to claim 5, wherein each of the plurality of game machines are configured to change the game rate after a game has ended based on the determined time.

* * * * *